US006463860B1

(12) United States Patent
Sodder, Jr.

(10) Patent No.: US 6,463,860 B1
(45) Date of Patent: Oct. 15, 2002

(54) METHOD AND APPARATUS FOR RE-RAILING A DE-RAILED RAILROAD CAR

(76) Inventor: George Sodder, Jr., 51 Maple St., Falls View, WV (US) 25002

( * ) Notice: Subject to any disclaimer, the term of this patent is extended or adjusted under 35 U.S.C. 154(b) by 0 days.

(21) Appl. No.: 09/927,465

(22) Filed: Aug. 13, 2001

(51) Int. Cl.[7] ..... B61F 9/00
(52) U.S. Cl. ..... 104/262; 104/263
(58) Field of Search ..... 104/262, 263, 104/261, 273, 264, 265; 213/75 R

(56) References Cited

U.S. PATENT DOCUMENTS 4,113,114 A * 9/1978 Pounds ..... 213/75 R
5,203,264 A * 4/1993 Sodder, Jr. ..... 104/263
5,325,791 A * 7/1994 Atchley et al. ..... 105/75
5,435,450 A * 7/1995 Delcambre ..... 213/100 R

* cited by examiner

*Primary Examiner*—S. Joseph Morano
*Assistant Examiner*—Frantz F. Jules
(74) *Attorney, Agent, or Firm*—Burns, Doane, Swecker & Mathis, LLP

(57) ABSTRACT

A de-railed railroad car is replaced onto a track by removing a knuckle from a coupler of the derailed railroad car and replacing it with an adapter member. The adapter member is attached to the coupler by the same pivot pin that held the knuckle. By then raising the adapter, the wheels of the de-railed railroad car can be lifted. By then moving the adapter horizontally, the wheels can be placed over the track, so that when the adapter is subsequently lowered, the wheels will be placed onto the track.

2 Claims, 6 Drawing Sheets

METHOD AND APPARATUS FOR RE-RAILING A DE-RAILED RAILROAD CAR

BACKGROUND OF THE INVENTION

The present application relates to a re-railer apparatus for placing de-railed railroad cars back onto a track.

The accidental de-railing of railroad cars during normal movement of the cars at a railroad yard and the like is not uncommon. When this occurs, it has been heretofore necessary to dispatch to the derailing site a track-mounted crane car which is able to re-rail the car by picking-up the de-railed end(s) of the car and returning it to the track. Such crane cars are quite costly, as a result of which there are only a limited number of such crane cars available. Hence, the crane car may not be located near the de-railing site, so a considerable delay could occur before the crane car arrives. Also, the cost of the services of such a crane car is normally quite high.

In U.S. Pat. No. 5,203,264 there is disclosed a re-railing unit for re-railing a de-railed car. The disclosure of that patent is incorporated by reference herein. The re-railing unit disclosed in that patent is depicted in accompanying FIGS. 13 and 14. The unit 8 is adapted to be attached to a mobile vehicle, such as a conventional front end loader (not shown) which transports the unit to and from a de-railing site. The unit comprises a base 10 having longitudinally spaced ends that carry respective ground supports 12. A support plate 14 is mounted on the base for longitudinal sliding movement relative thereto (to the right and left in FIG. 13). A lifting arm 16 is mounted on the support plate and includes a contacting structure in the form of a pair of hook-shaped lugs 18 20 configured to grip the underside of certain types of drawhead 19 projecting from the end of a conventional railroad car. A pair of hydraulic rams 22 are mounted on the support plate and are operably connected to the lifting arm for raising the lifting arm and an end of the rail car. Another hydraulic ram (not shown) is provided for sliding the support plate 14 generally horizontally relative to the base for repositioning the wheels of the raised rail car over the rails of a track, whereupon the rams 22 are retracted to lower the wheels onto the track rails.

While functioning successfully to re-rail railroad cars, room for improvement remains, because certain types of rail car drawbars are not susceptible of being reliably raised by the hook-shaped lugs 78, 80.

Therefore, it would be desirable to enable the apparatus described in U.S. Pat. No. 5,203,264 to reliably lift a greater number of drawbar types.

SUMMARY OF THE INVENTION

The present invention relates to a method of re-railing a de-railed railroad car. The method includes the steps of:

A) positioning in front of the de-railed railroad car a re-railing unit comprising:
   (i) a base having longitudinally spaced ends,
   (ii) a support plate mounted on the base for longitudinal sliding movement thereon,
   (iii) a lifting mechanism mounted on the support plate,
   (iv) a lifting arm suspended at its upper end from the lifting mechanism and being raisable by the lifting mechanism, the lifting arm having a first engagement structure, and
   (v) a sliding mechanism for sliding the support plate longitudinally across said base;

B) removing a knuckle from a body of a coupler of the de-railed rail car by removing a pivot pin which pivotably connects the knuckle to the body;

C) inserting into the body an adapter member and connecting the adapter member to the body by inserting a pivot pin through the body and the adapter member, the adapter member having a second engagement structure engageable by the first engagement structure;

D) actuating the sliding mechanism to position the lifting arm beneath the adapter member;

E) actuating the lifting mechanism to raise the lifting arm such that the first engagement structure engages the second engagement structure and the rail car;

F) actuating the sliding mechanism to position de-railed wheels of the rail car over the rails from which they are de-railed; and G) actuating the lifting mechanism to lower the wheels onto the rails.

Another aspect of the present invention relates to an apparatus for re-railing a de-railed railroad car. The apparatus includes an adapter member adapted to be mounted to a railroad car coupler. The adapter member comprises an ear adapted to be inserted between upper and lower flanges of the coupler. The ear including a vertical hole at one end thereof. The hole is adapted to receive a pivot pin for connecting the ear to the upper and lower flanges. The adapter also includes a leg disposed at an end of the adapter opposite the ear for engaging an underside of the coupler. The apparatus also includes a re-railer unit which comprises a base having longitudinally spaced ends and connecting arms releasably connectable to a vehicle. Hydraulic ground support members are carried adjacent respective ends of the base and include vertically adjustable elements. A support plate is mounted on the base for longitudinal sliding movement thereon. A pair of upright hydraulic lifting rams extend upwardly from the support plate. A lifting arm is suspended at its upper end from the lifting rams and is disposed between the lifting rams. A lower end of the lifting arm carries an engagement structure adapted to engage the adapter member. The lifting arm and the drawhead are raisable in response to extension of the lifting rams. A power actuator is connected between the base and the support plate for sliding the support plate longitudinally across the base to reposition wheels of the raised railroad car over the track from which it has become de-railed so that the wheels can be lowered onto the track by the lifting rams.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
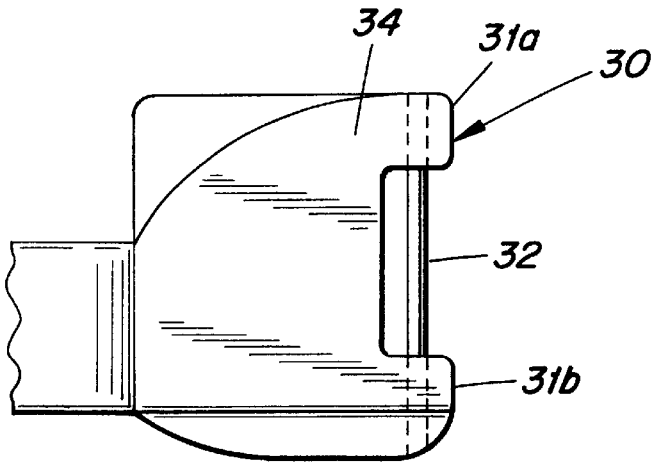
FIG. 1 (PRIOR ART)
FIG. 1 is a side elevational view of a conventional coupler for a railroad car, with a knuckle portion of the coupler removed.
Figure 2:
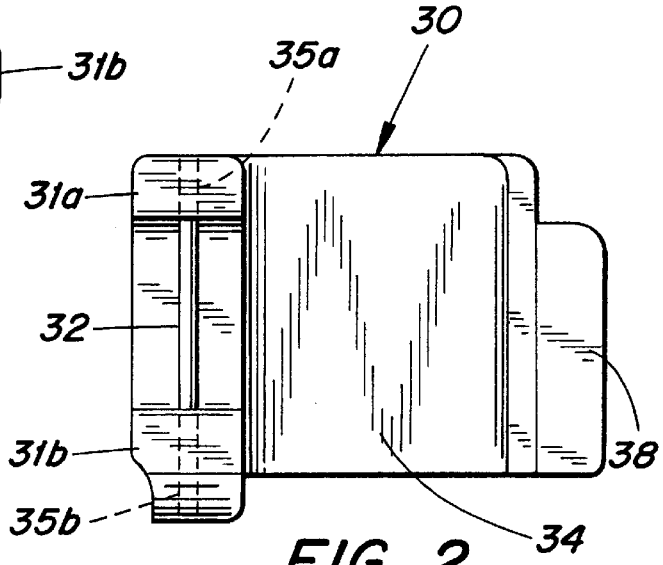
FIG. 2 (PRIOR ART)
FIG. 2 a front elevational view of FIG. 1.
Figure 3:
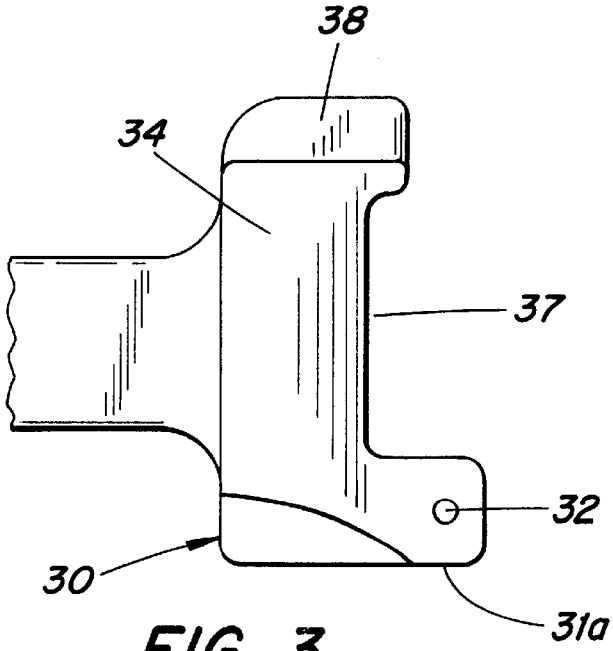
FIG. 3 (PRIOR ART)
FIG. 3 is a top view of FIG. 1.
Figure 4:
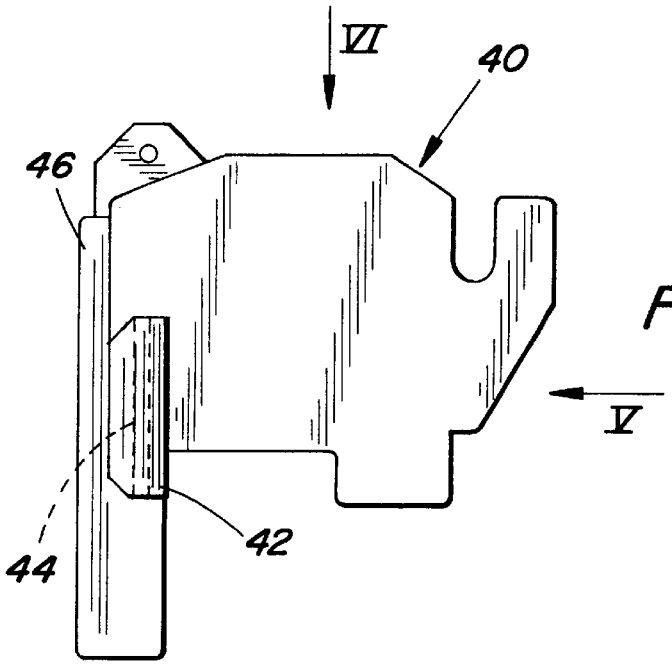
FIG. 4 is a side elevational view of an adapter according to the present invention.
Figure 5:
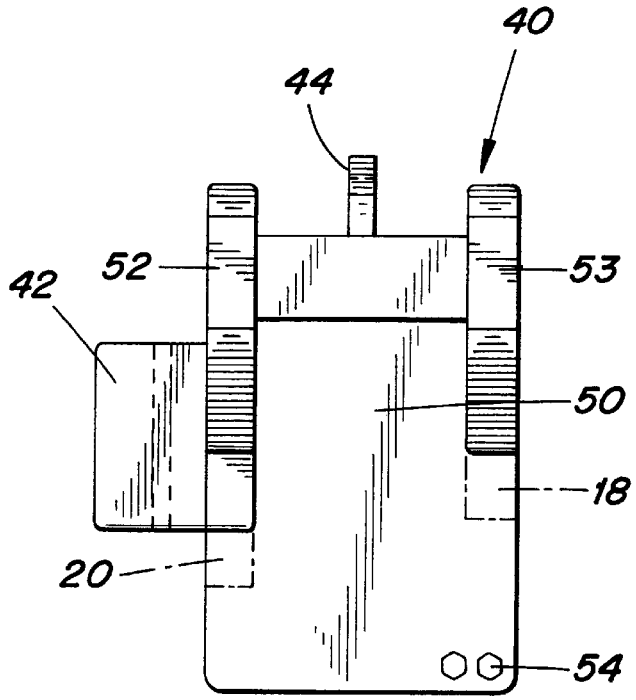
FIG. 5 is a rear view taken in the direction of arrow V in FIG. 4.
Figure 6:
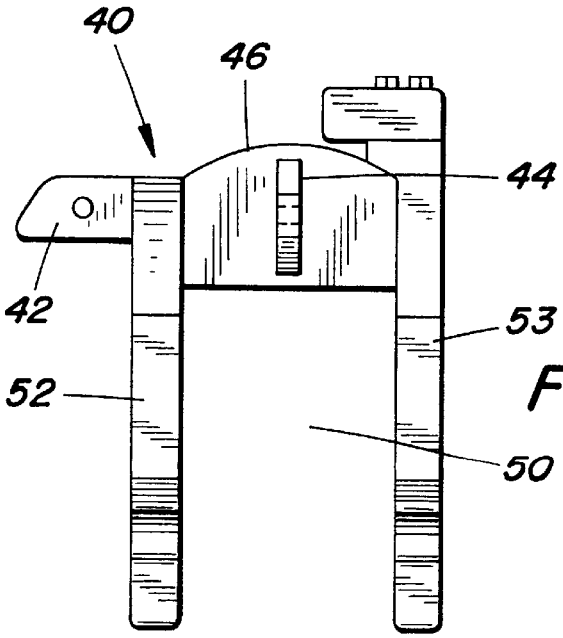
FIG. 6 is a top plan view of the adapter taken in the direction of the arrow VI in FIG. 4.
Figure 7:
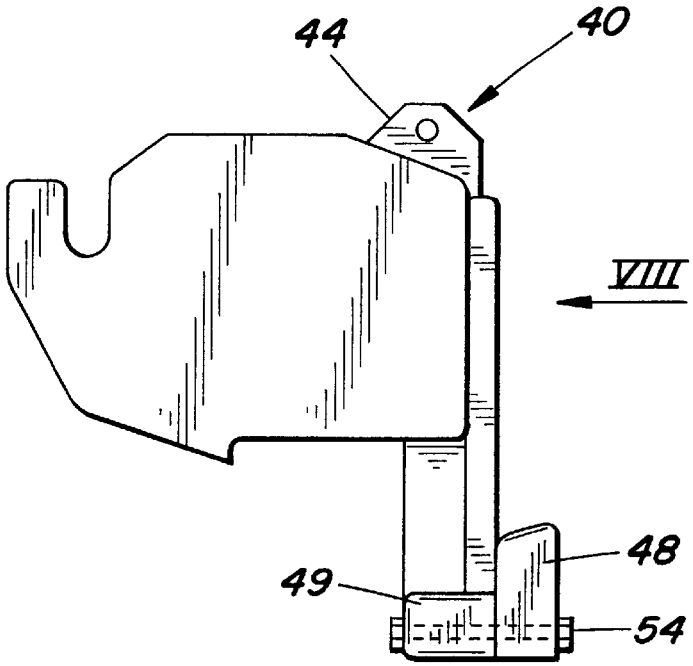
FIG 7 is a side elevational view of the adapter from a side opposite that of FIG. 4.
Figure 8:
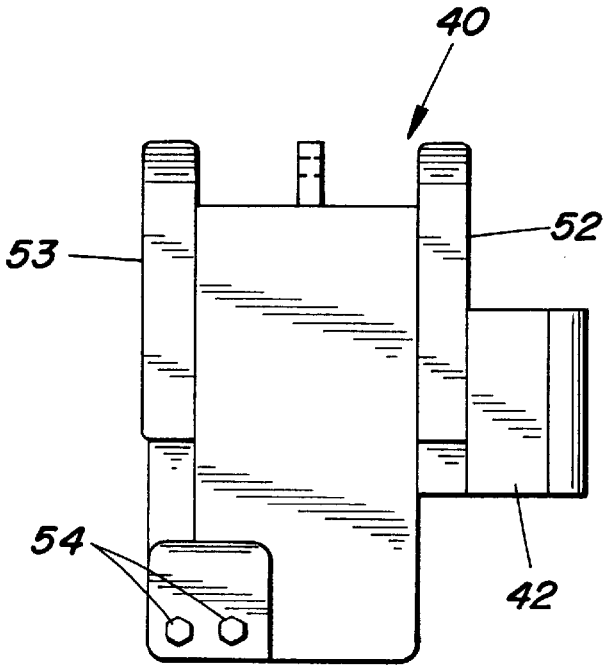
FIG. 8 is a front elevational view of the adapter taken in the direction of the arrow VIII in FIG. 7.

Depicted in FIGS. 1–3 is a conventional coupler 30 of a railway car with a knuckle thereof removed. That is, a knuckle is typically pivotably mounted at one of its ends by a pivot pin 32 which is mounted in upper and lower flanges 31*a*, 31*b*. The knuckle is adapted to pivot open to enable a knuckle of an adjacent railway car to be received in the coupler. Then when both knuckles close, the coupling of the two cars is effected.

Figure 9:
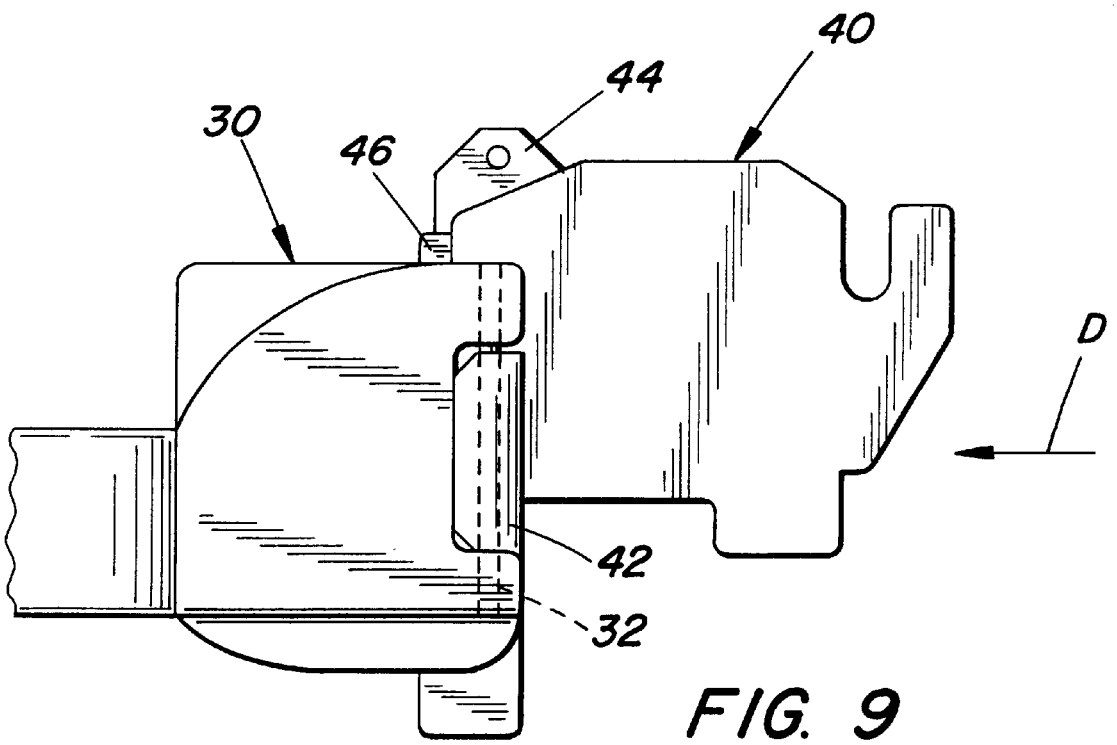
FIG. 9 is a view similar to FIG. 4 showing the adapter mounted in the coupler of FIG. 1.
Figure 10:
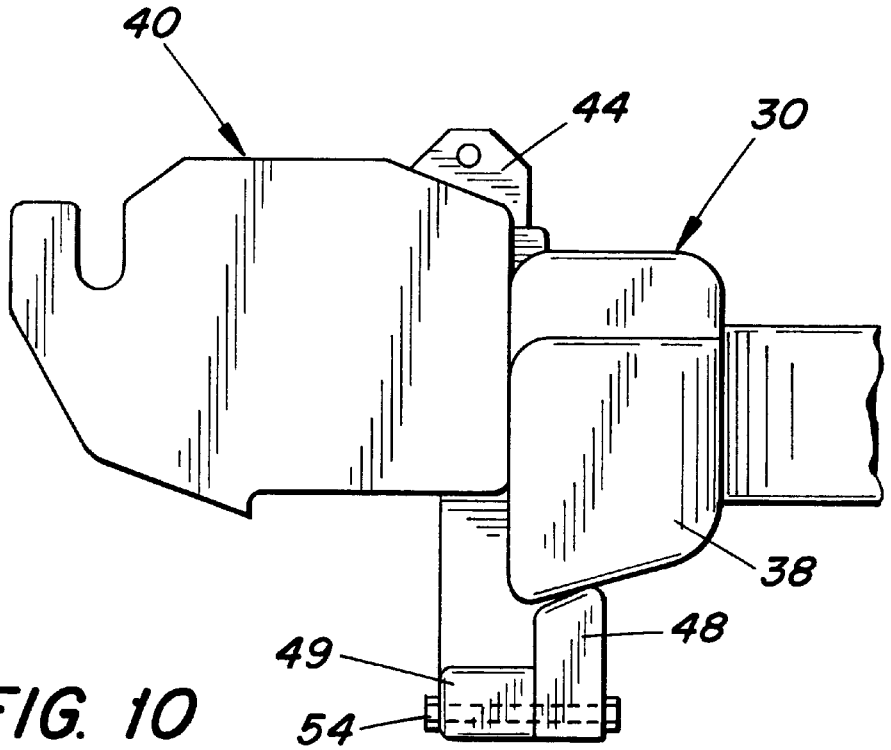
FIG. 10 is a view similar to FIG. 7 showing the adapter mounted in the coupler.

If the railway car having the coupler 30 is de-railed, then, according to the present invention, the knuckle is removed and the car is re-railed by attaching to a body 34 of the coupler 30 an adapter 40 depicted in FIGS. 4–8. The adapter is formed of metal (e.g. cast steel or iron) and includes an ear 42 having a vertical hole 44 extending therethrough. The adapter is lifted by hand, or by a crane attached to a lifting bracket 44 of the adapter, and maneuvered in a generally horizontal direction D (see FIG. 9) to position the ear 42 between the upper and lower flanges 31*a*, 31*b* of the coupler, such that the hole 44 is aligned with holes 35*a*, 36*a* formed in the flanges 31*a*, 31*b* respectively. The pivot pin 32 is then inserted through the holes 35*a*, 44, 36*a*, and the adapter is swung about the axis of the pin 32 to position a front protuberance 46 of the adapter within a recess 37 of the coupler (see FIG. 9). Simultaneously, a leg 48 of the adapter is brought into If the railway car having the coupler 30 is de-railed, then, according to the present invention, the knuckle is removed and the car is re-railed by attaching to a body 34 of the coupler 30 an adapter 40 depicted in FIGS. 4–8. The adapter is formed of metal (e.g. cast steel or iron) and includes an ear 42 having a vertical hole 44 extending therethrough. The adapter is lifted by hand, or by a crane attached to a lifting bracket 44 of the adapter, and maneuvered in a generally horizontal direction D (see FIG. 9) to position the ear 42 between the upper and lower flanges 31*a*, 31*b* of the coupler, such that the hole 44 is aligned with holes 35*a*, 36*a* formed in the flanges 31*a*, 31*b* respectively. The pivot pin 32 is then inserted through the holes 35*a*, 44, 36*a*, and the adapter is swung about the axis of the pin 32 to position a front protuberance 46 of the adapter within a recess 37 of the coupler (see FIG. 9). Simultaneously, a leg 48 of the adapter is brought into underlying relationship with a portion 38 of the couple (see FIG. 7 and 10).

Figure 11:
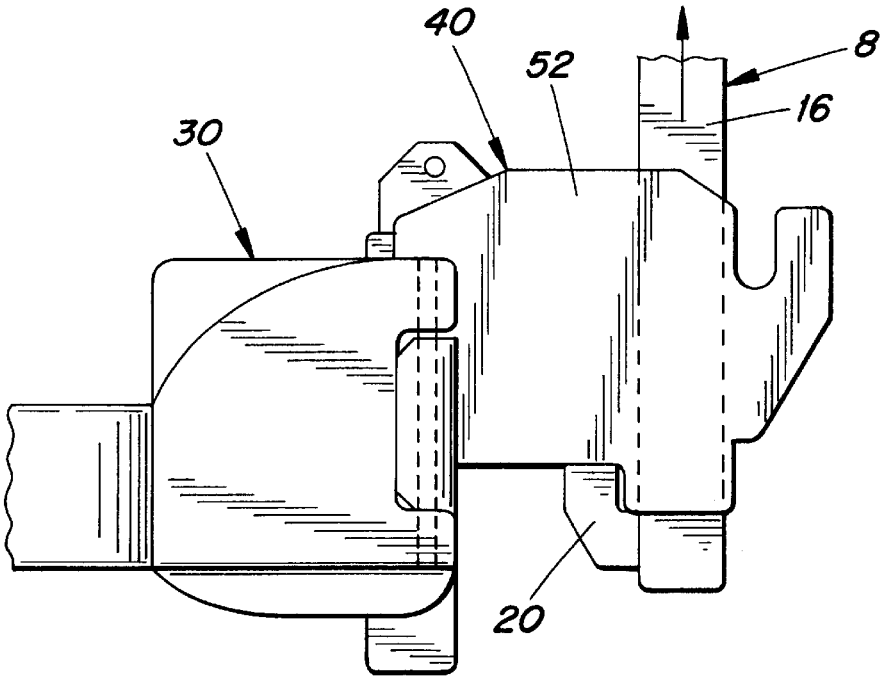
FIG. 11 is view similar to FIG. 9 after the lifting arm of a re-railing unit is moved interposition.
Figure 12:
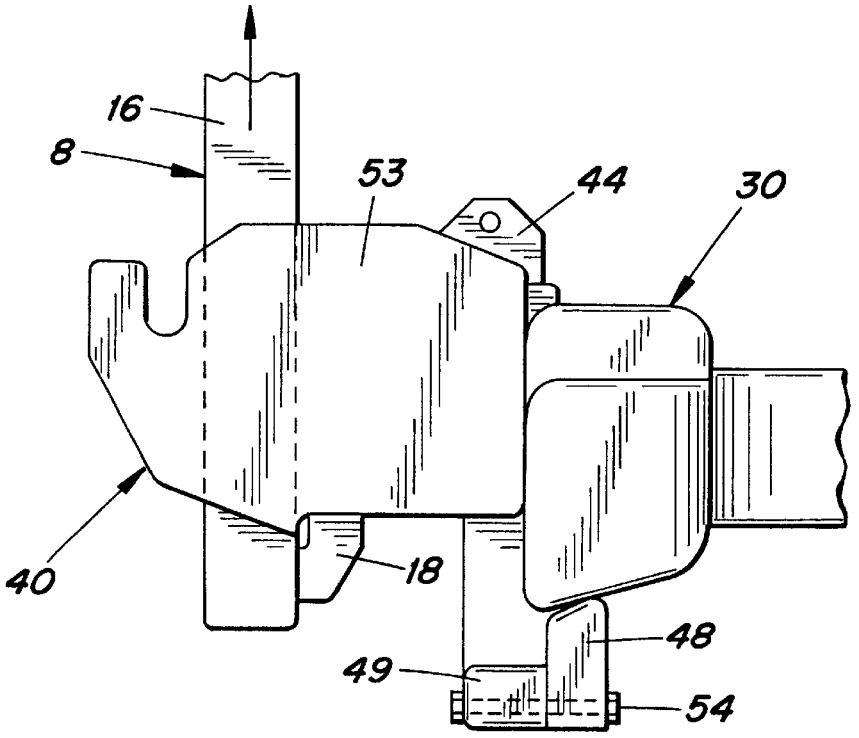
FIG. 12 is a view similar to FIG. 10 after the lifting arm has been moved into position.
Figure 13:
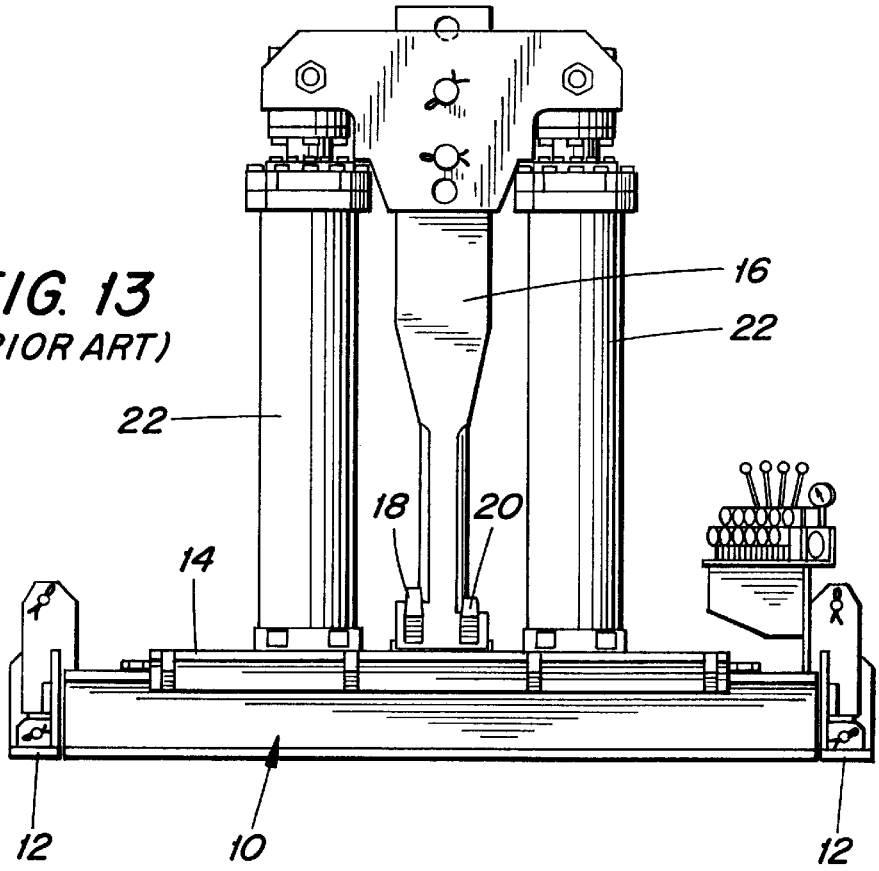
FIG. 13 (PRIOR ART)
FIG. 13 is a front elevational view of a re-railer unit according to the present invention a lifting arm thereof in a lowered position.
Figure 14:
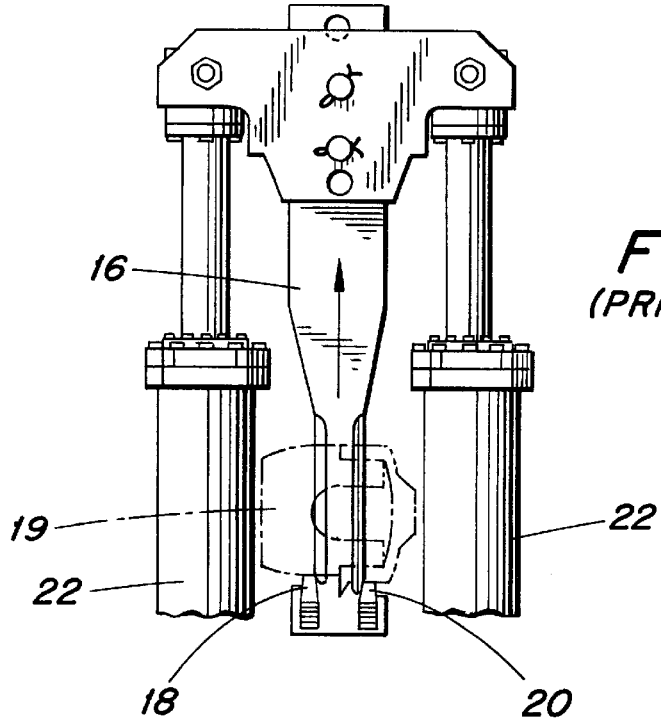
FIG. 14 (PRIOR ART)
FIG. 14 is a view similar to FIG. 13 after the lifting arm has raised the wheels of the car.

It will be appreciated that if the adapter 40 is then raised, the coupler 30 will also be raised. The raising of the adapter is performed by the re-railing unit 8 described earlier in connection with FIGS. 1 and 2. That is, the support plate 14 is slid along the base 10 to bring the lifting arm 16 into alignment with a recess 50 of the adapter formed between a pair of side plates 52, 53 (see FIG. 5). Then, the re-railing unit is advanced (e.g., by means of the vehicle carrying the unit) so that the lifting arm 16 enters the recess 50, thereby positioning the lugs 18, 20 beneath respective ones of the side portions 52, 53 (see FIGS. 5, 11 and 12). By then actuating the rams 22 the lifting arm 16 is raised, along with the coupler 30, in order to raise the end of the respective railway car. Then, the support plate 14 is slid along the base to displace the coupler and the front end of the railway car over the tracks. Then, the lifting arm 16 is lowered to enable the wheels of the car to rest upon the tracks, i.e., to become re-railed.

The leg 48 is removably attachable to a portion 49 of the adapter by a plurality of bolts 54, so that the leg 48 can be removed and replaced by a differently configured leg which can engage beneath a differently shaped coupler. If necessary, shims can be placed between the leg 48 and the portion 49 to extend the leg 48 outwardly.

It will be appreciated that the leg 48 and the bolts 54 are the only removable parts of the adapter 40.

The adapter 40 enables the unit 10 to exert lifting forces on more types of railcar couplers than was previously possible.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A method of re-railing a de-railed railroad car which has been de-railed from rails, comprising the steps of:

A) positioning in front of the de-railed railroad car a re-railing unit comprising:
(i) a base having longitudinally spaced ends,
(ii) a support plate mounted on the base for longitudinal sliding movement thereon,
(iii) a lifting mechanism mounted on the support plate,
(iv) a lifting arm suspended at its upper end from the lifting mechanism and being raisable by the lifting mechanism, the lifting arm having an engagement structure, and
(v) a sliding mechanism for sliding the support plate longitudinally across said base;

B) removing a knuckle from a body of a coupler of the de-railed railroad car by removing from upper and lower spaced-apart flanges of the body a pivot pin which pivotably connects the knuckle to the body;

C) inserting into the body an adapter member in a generally horizontal direction and connecting the adapter member to the body by inserting a pivot pin through the body and upper and lower flanges and through an ear of the adapter member which is positioned between the upper and lower flanges, the adapter member being engageable by the engagement structure;

D) actuating the sliding mechanism to position the lifting arm adjacent the adapter member;

E) actuating the lifting mechanism to raise the lifting arm such that the engagement structure engages the adapter and raises the railroad car;

F) actuating the sliding mechanism to position de-railed wheels of the railroad car over the rails from which they are de-railed; and G) actuating the lifting mechanism to lower the wheels onto the rails.

2. The method according to claim 1 wherein step C further includes causing a front protuberance of the adapter member to be positioned within a recess of the coupler and a leg of the adapter member to be positioned beneath the coupler.

* * * * *